US008272577B2

(12) United States Patent
Bartelmuss et al.

(10) Patent No.: US 8,272,577 B2
(45) Date of Patent: Sep. 25, 2012

(54) APPARATUS FOR SPRAYING A LIQUID

(76) Inventors: Klaus Bartelmuss, Teufenbach (AT); Heinz Bartelmuss, Teufenbach (AT)

( * ) Notice: Subject to any disclaimer, the term of this patent is extended or adjusted under 35 U.S.C. 154(b) by 374 days.

(21) Appl. No.: 12/644,435

(22) Filed: Dec. 22, 2009

(65) Prior Publication Data

US 2010/0270396 A1 Oct. 28, 2010

(30) Foreign Application Priority Data

Apr. 27, 2009 (AT) ..... A 639/2009

(51) Int. Cl.
*B05B 15/02* (2006.01)

(52) U.S. Cl. ..... 239/116; 239/114; 239/123; 239/550; 239/566

(58) Field of Classification Search ..... 239/114, 239/115, 116, 123, 548, 550, 566
See application file for complete search history.

(56) References Cited

U.S. PATENT DOCUMENTS

| | | | | | |
|---|---|---|---|---|---|
| 374,290 | A | * | 12/1887 | Boorn | 239/123 |
| 1,972,001 | A | * | 8/1934 | Witham, Jr. et al. | 239/566 |
| 2,784,032 | A | * | 3/1957 | Johansson | 239/116 |
| 2,884,203 | A | * | 4/1959 | Broughton | 239/116 |

* cited by examiner

*Primary Examiner* — Steven J Ganey
(74) *Attorney, Agent, or Firm* — Laurence A. Greenberg; Werner H. Stemer; Ralph E. Locher

(57) ABSTRACT

An apparatus for spraying a liquid, such as a cleaning liquid or a lubricating liquid, onto a wire or onto a felt in a plant for paper production. The apparatus has pipeline for supplying the liquid and spray nozzles for ejecting the liquid. A shaft with a cleaning device for the spray nozzles or for the inner wall of the pipeline is disposed within the pipeline. The shaft includes a cylindrical sleeve which has a slotted guide and a thread and is arranged in a housing which adjoins the pipeline, the thread interacting with a control spindle and, furthermore, a bolt or the like being provided which can be adjusted transversely with respect to the housing and projects into the slotted guide in a first position, as a result of which, during a rotation of the control spindle, the shaft is displaced in the longitudinal direction of the pipeline. Here, a second bolt or the like is provided, by which the control spindle can be coupled to the cylindrical sleeve in terms of its rotation, as a result of which, after adjustment of the first bolt or the like out of the slotted guide, the shaft can be rotated by the control spindle.

11 Claims, 14 Drawing Sheets

APPARATUS FOR SPRAYING A LIQUID

CROSS-REFERENCE TO RELATED APPLICATION

This application claims the priority, under 35 U.S.C. §119, of Austrian patent application A 639/2009, filed Apr. 27, 2009; the prior application is herewith incorporated by reference in its entirety.

BACKGROUND OF THE INVENTION

Field of the Invention

The invention relates to an apparatus for spraying a liquid, such as a cleaning liquid or a lubricating liquid, onto the wire or onto the felt in a paper production plant. The apparatus has a pipeline for supplying the liquid, spray nozzles, and a shaft with a cleaning device for the spray nozzles or for the inner wall of the pipeline being situated within the pipeline. The shaft is configured, furthermore, with a cylindrical sleeve which is arranged in a housing that adjoins the pipeline, the sleeve having a slotted guide and, furthermore, a thread which interacts with a control spindle, and a bolt or the like being provided which can be adjusted transversely with respect to the housing and projects into the slotted guide in a first position, as a result of which, during a rotation of the control spindle, the shaft can be displaced in the longitudinal direction of the pipeline.

In an apparatus for spraying liquids, such as cleaning liquids or lubricating liquids, onto wires or onto felts in a plant for producing paper, there is the requirement to provide a cleaning device within the pipeline, by which cleaning device the spray nozzles which are situated in the pipeline and the inner wall of the pipeline can be cleaned. For this purpose, brushes, doctors or the like which can either be displaced in the direction of the pipeline or which can be pivoted within the pipeline are provided within the pipeline.

It is known here that the cleaning device is situated on a displaceable shaft and that a housing which extends in the axial direction of the pipeline is flange-connected to the pipeline, in which housing a control rod is situated which is connected on one side rigidly to the shaft and which is adjoined on the other side by a cylindrical sleeve which is configured with a slotted guide which extends in its longitudinal direction and with an internal thread. A bolt which protrudes transversely from the housing projects into the slotted guide and the internal thread is assigned a control spindle which can be rotated by means of a handwheel which is situated outside the housing.

As a result of a rotation of the handwheel and therefore of the control spindle, the thread of which interacts with the internal thread of the sleeve, the sleeve is displaced within the housing in its longitudinal direction on account of the slotted guide. As a result of this displacement of the sleeve, the control rod and the shaft which is connected fixedly to it and on which the cleaning device is situated are also displaced within the pipeline in its longitudinal direction, as a result of which the spray nozzles which are situated in it are cleaned.

At that end of the slotted guide which is remote from the shaft, said slotted guide is configured with an obliquely extending section, as a result of which the sleeve and the shaft are rotated by approximately 45° on account of the bolt which projects into it, as a result of which the cleaning device is pivoted away from the spray nozzles. This is the inoperative position of the cleaning device, in which the liquid can be fed to the spray nozzles.

By way of that prior art apparatus, however, only cleaning of the spray nozzles takes place by the displacement of the cleaning device.

Furthermore, a device is known, in which the handwheel is coupled rotationally to the shaft for the cleaning device, as a result of which the cleaning device can be pivoted within the pipeline, with the result that not only the spray nozzles but also the inner wall of the pipeline can be cleaned. However, it is not possible by way of this known device to displace the cleaning device in the longitudinal direction of the pipeline, for which reason the technical requirements are not met, since a displacement of the cleaning device in the longitudinal direction of the pipeline is required for optimum cleaning of the spray nozzles.

SUMMARY OF THE INVENTION

It is accordingly an object of the invention to provide a device for spraying liquids, which overcomes the above-mentioned disadvantages of the heretofore-known devices and methods of this general type and which provides for a device, in which the cleaning device can be both displaced and pivoted as desired within the pipeline, wherein the cleaning device slides along the inner wall of the pipeline.

With the foregoing and other objects in view there is provided, in accordance with the invention, an apparatus for spraying a liquid (e.g., cleaning liquid, lubricating fluid) onto a wire or onto a felt in a paper production facility, comprising:

a pipeline for supplying the liquid, said pipeline defining a longitudinal direction;

spray nozzles formed to eject the liquid;

a shaft with a cleaning device for the spray nozzles or for the inner wall of the pipeline disposed within said pipeline;

said shaft being configured with a cylindrical sleeve formed with a slotted guide and a thread and disposed in a housing adjoining said pipeline;

a control spindle disposed to interact with said thread;

a first engagement device disposed for transverse adjustment relative to said housing and projecting into said slotted guide in a first position, as a result of which, during a rotation of said control spindle, said shaft is displaced in the longitudinal direction of said pipeline;

a second engagement device disposed for coupling said control spindle to said cylindrical sleeve in terms of a rotation thereof, as a result of which, after disengagement of said first engagement device out of said slotted guide, said shaft is rotatable by said control spindle.

In other words, the objects of the invention are achieved in that a second bolt or the like being provided, by which the control spindle can be coupled to the cylindrical sleeve in terms of its rotation, as a result of which, after adjustment of the first bolt or the like out of the slotted guide, the shaft can be rotated by the control spindle.

The second bolt or the like which is situated in a transverse hole of the control spindle is preferably loaded toward radial adjustment under the action of a control spring, said second bolt or the like bearing against the inner end of the first bolt or the like and, after an adjustment of the first bolt or the like radially to the outside, projecting into the slotted guide under the action of the control spring.

The first bolt or the like can preferably be adjusted into a first position, in which it projects so far into the slotted guide that the second bolt or the like is situated outside the slotted guide, into a second position, furthermore, in which both the first bolt or the like and the second bolt or the like are situated in the slotted guide, and additionally into a third position, in which it is situated outside the slotted guide, and can be fixed in said positions.

According to one design variant, the second bolt or the like which can be inserted into a transverse hole of the control spindle is of such a length that it projects into the slotted guide. Here, the first bolt or the like can be adjusted into a first position, in which it projects into the slotted guide, and into a second position, in which it is situated outside the slotted guide. In particular, the wall of the housing can be configured with a threaded hole, into which the first bolt or the like can be screwed and, as a result, can have its position set in relation to the slotted guide.

Other features which are considered as characteristic for the invention are set forth in the appended claims.

Although the invention is illustrated and described herein as embodied in an apparatus for spraying a liquid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
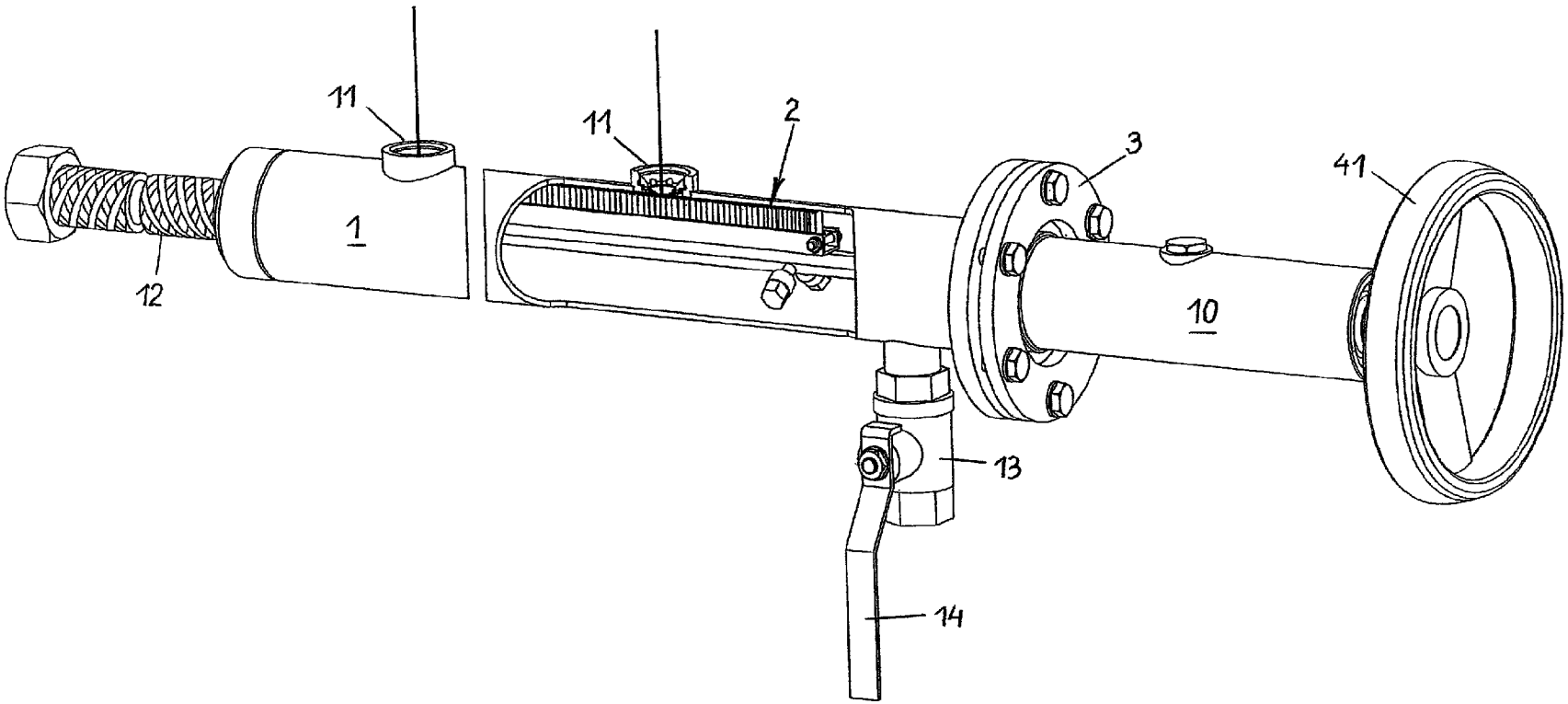
FIG. 1 shows an apparatus according to the invention, in an axonometric illustration.

Referring now to the figures of the drawing in detail and first, particularly, to FIG. 1 thereof, there is shown a pipeline 1 which is configured with spray nozzles 11 and in which a cleaning device 2 is situated. The left-hand end of the pipeline 1 is adjoined by a feed line 12, via which the pipeline 1 is fed a liquid, such as a cleaning liquid or a lubricating liquid, in particular water, which is ejected through the spray nozzles 11 onto a wire or onto a felt in a plant for paper production. A cylindrical housing 10 is attached by means of a flange 3 to the right-hand end of the pipeline 1, in which cylindrical housing 10 a control device for the cleaning device 2 is situated, it being possible for the control device to be actuated by a handwheel 41. Furthermore, a connection piece 13, in which a valve is situated which can be controlled by a control lever 14, is connected to the pipeline 1. Rinsing of the pipeline 1 can take place via the connection piece 13 during the cleaning operation. Periodic cleaning of the pipeline 1 is therefore required, since dirt particles can be situated in the liquid which is fed to the pipeline 1, which dirt particles are deposited on the inner side of the spray nozzles 11, as a result of which the functionality of the spray nozzles 11 is impaired, or which dirt particles are deposited on the inner wall of the pipeline 1, as a result of which the functionality of the cleaning device is likewise impaired.

Figure 2:
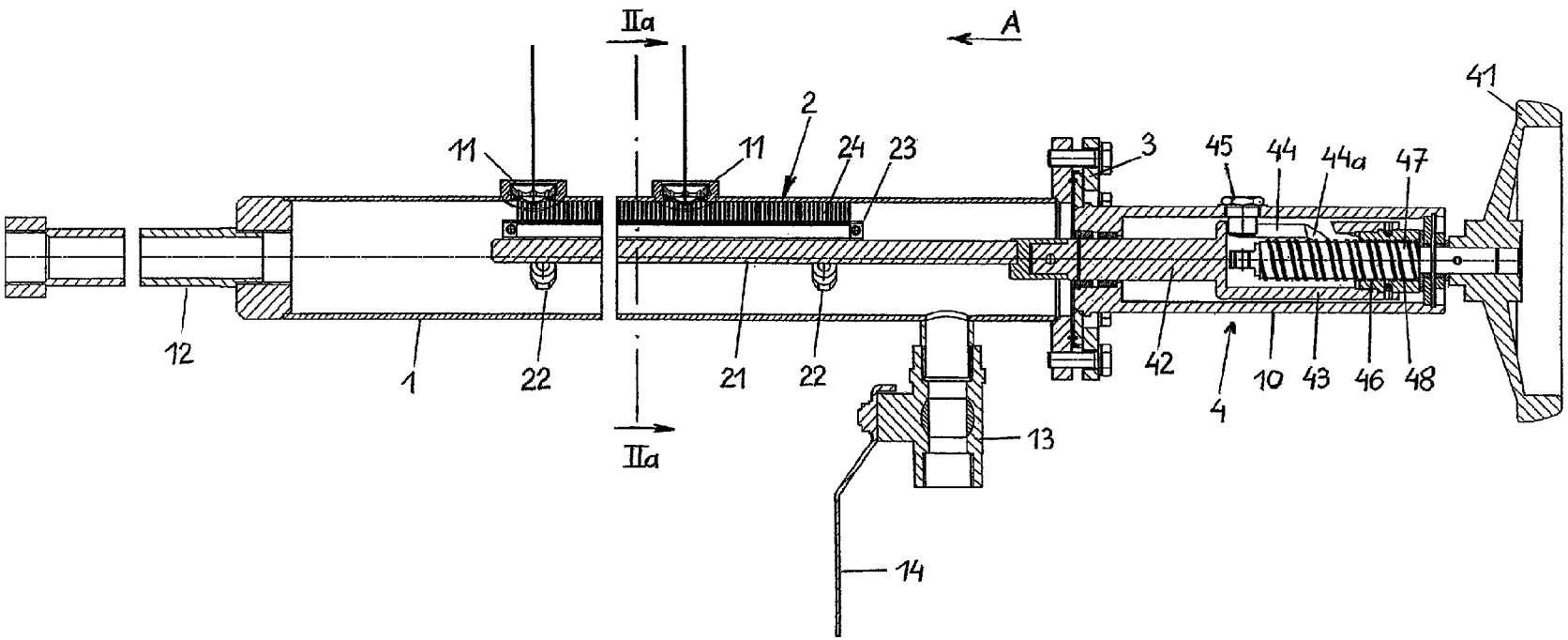
FIG. 2 and FIG. 2A show a first embodiment of the apparatus according to the invention in an axial section and in section according to the line IIA-IIA of FIG. 2, in a first operating position.
Figure 2A:
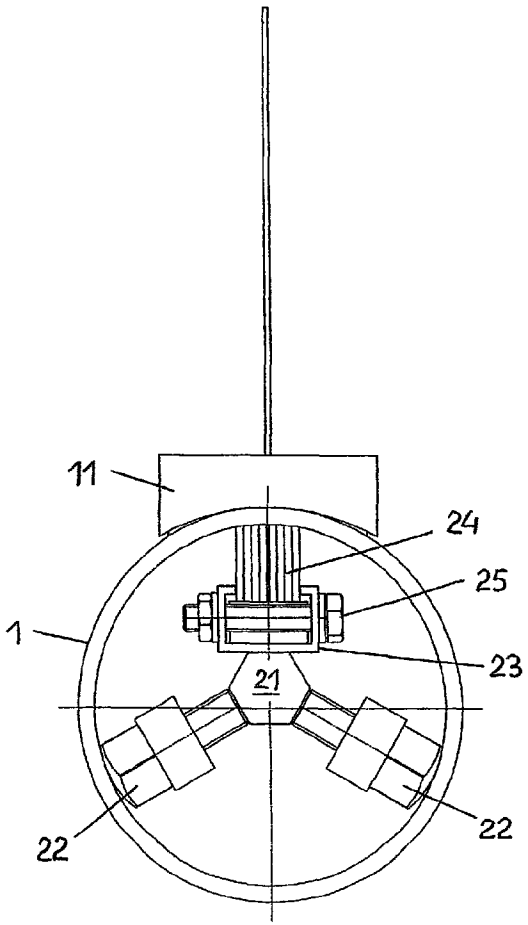

As can be seen, furthermore, from FIG. 2 and FIG. 2A, the cleaning device 2 is situated on a shaft 21 which is configured with spacer elements 22 and with a carrier 23 for a brush 24, the brush 24 being held on the carrier 23 by means of a threaded bolt 25.

The control device 4 which is situated within the housing 10 has a control rod 42 which penetrates the flange 3 in a sealed manner and which is connected rigidly to the shaft 21. Within the housing 10, the control rod 42 is adjoined by a cylindrical sleeve 43 which is connected fixedly to said control rod 42 and is configured with a slot 44, a groove or the like, into which a bolt 45 projects which is screwed into the housing 10. At that end of the slot 44 which faces away from the pipeline 1, which slot 44 extends in the longitudinal direction of the sleeve 43, said slot 44 is configured with a section 44*a* which extends transversely with respect to the longitudinal direction and opens into a hole which penetrates the sleeve 43. Furthermore, the sleeve 43 is configured with an internal thread 46 at its end which faces away from the pipeline 1. A control spindle 47 projects into the sleeve 43, which control spindle 47 is configured with an external thread 48 which interacts with the internal thread 46 of the cylindrical sleeve 43. The handwheel 41, by which the control spindle 47 can be rotated, is attached to the control spindle 47.

The function of this apparatus is as follows:

The control spindle 47 is rotated by a rotation of the handwheel 41. As a result of this, the sleeve 43 and the control rod 42 are displaced with respect to the housing 10, and the shaft 21 and, with it, the brush 24 are displaced with respect to the pipeline 1 in the direction of the arrow A, by means of the external thread 48 of the control spindle 47 and the internal thread 46 of the sleeve 43 and on account of the bolt 45 which projects into the slot 44, as a result of which a slotted guide is formed. As a result of this displacement, effective cleaning of the spray nozzles 11 takes place by means of the brush 24.

Figure 3:
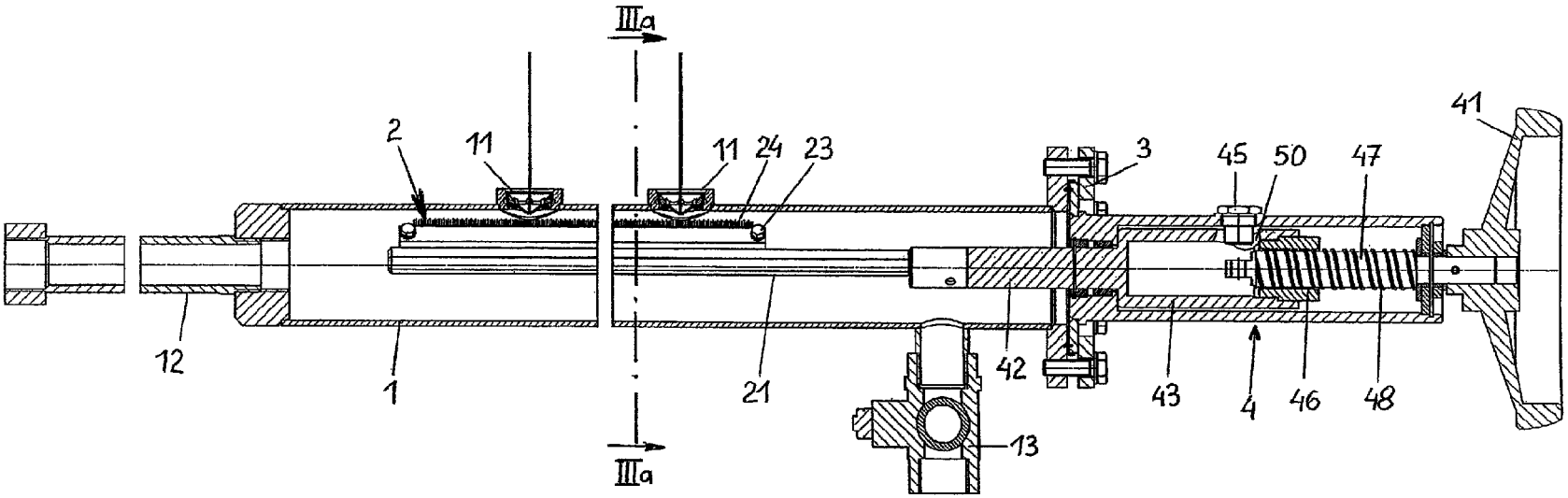
FIG. 3 and FIG. 3A show the first embodiment in an axial section and in section according to the line IIIA-IIIA of FIG. 3, in a second operating position.
Figure 3A:
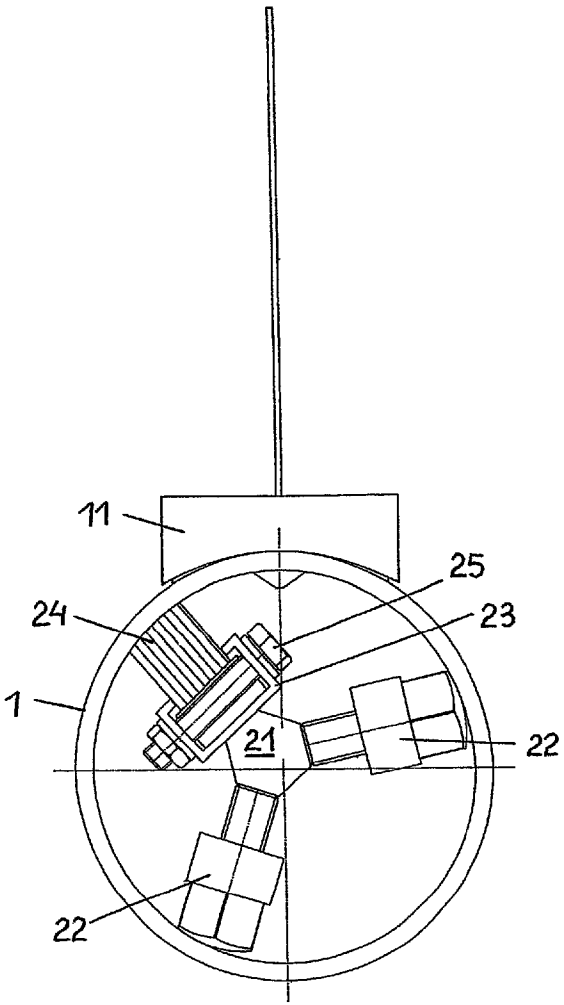

At the end of this control movement, the bolt 45 passes into the obliquely extending section 44*a* of the slot 44, as a result of which the sleeve 43, the control rod 42 and the shaft 21 are rotated by approximately 45°. This position of the shaft 21 is shown in FIG. 3 and FIG. 3A. As a result, the spray nozzles 11 are released by the brush 24. Since the bolt 45 passes at the end of the oblique section 44*a* of the slot 44 into the hole 50 which is situated there, a further rotation of the sleeve 43 and therefore a displacement of the brush 24 are no longer possible.

Figure 4A:
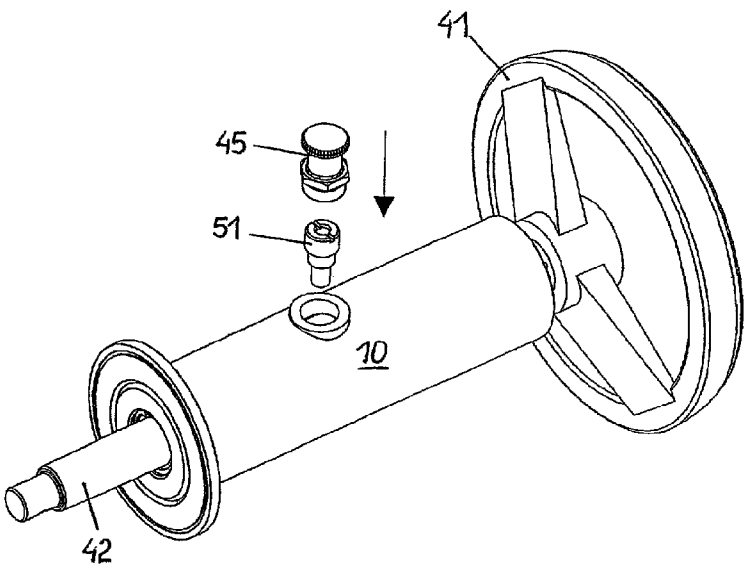
FIG. 4 and FIG. 4A show a detail of the first embodiment of an apparatus according to the invention, in an axonometric illustration.
Figure 4:
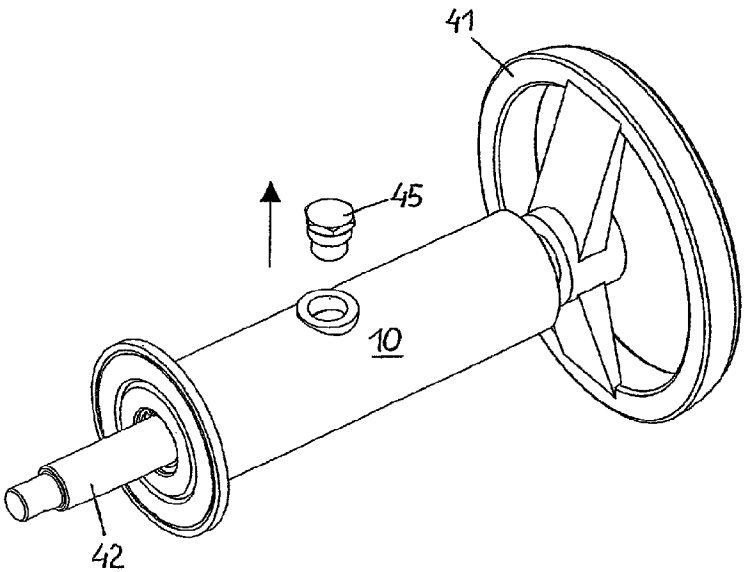

As is shown, furthermore, in FIG. 4 and FIG. 4A, a further bolt 51, by which the sleeve 43 and the control spindle 47 can be coupled rotationally to one another, can be inserted into the housing 10 in addition to the bolt 45.

Figure 5:
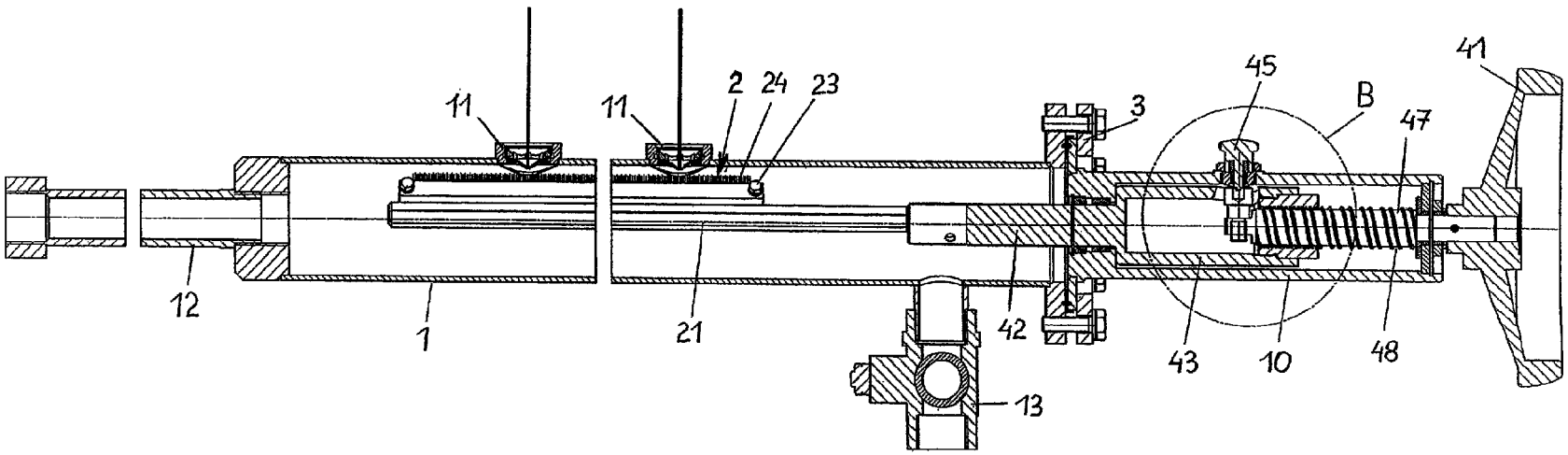
FIG. 5 shows the first embodiment in an axial section, in a third operating position.
Figure 5A:
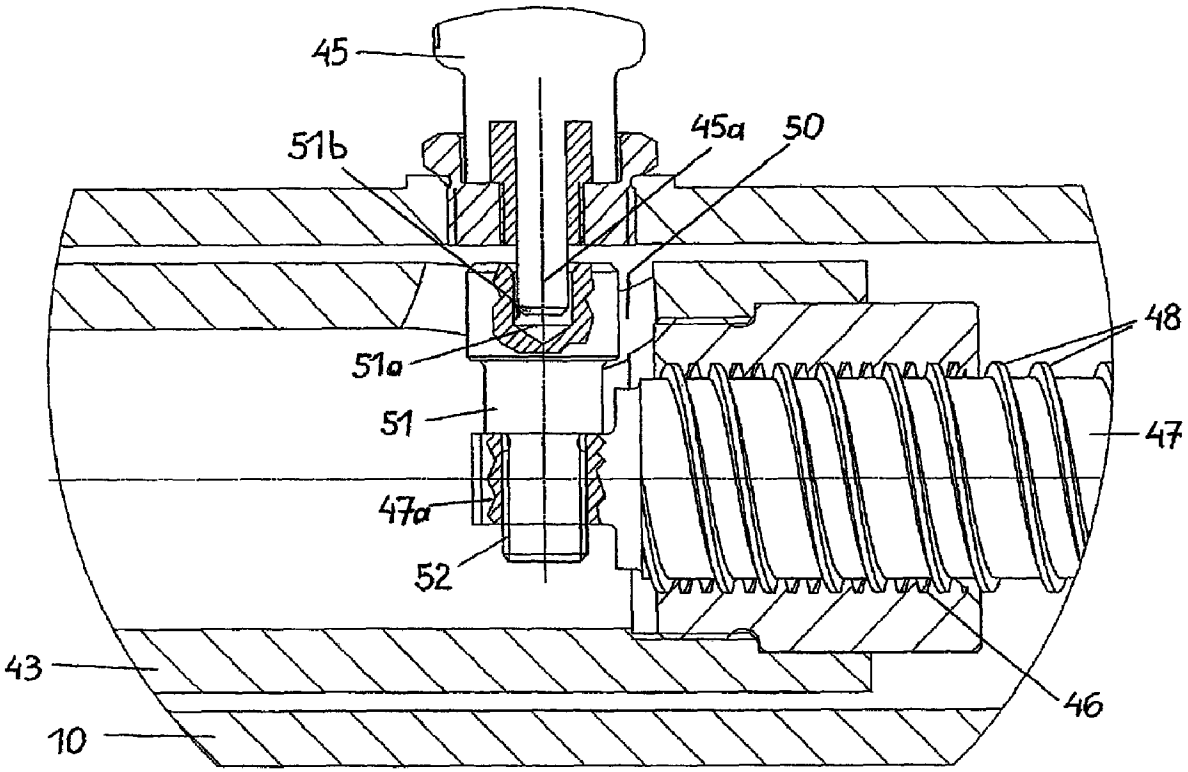
FIG. 5A shows detail B of FIG. 5 on an enlarged scale compared with FIG. 5.

As can be seen from FIG. 5 and FIG. 5A, the control spindle 47 is configured with a projection 47*a* at its end which lies opposite the handwheel 41, which projection 47*a* has a transverse hole 52, into which the second bolt 51 projects. Since the head 51*a* of the second bolt 51 is situated in the hole 50 and, furthermore, the first bolt 45 projects with a projection 45*a* into a hole 51*b* which is situated in the head 51*a* of the second bolt 51, the control spindle 47 cannot be either rotated or displaced. Rather, the cleaning device is situated in its inoperative position.

Figure 5B:
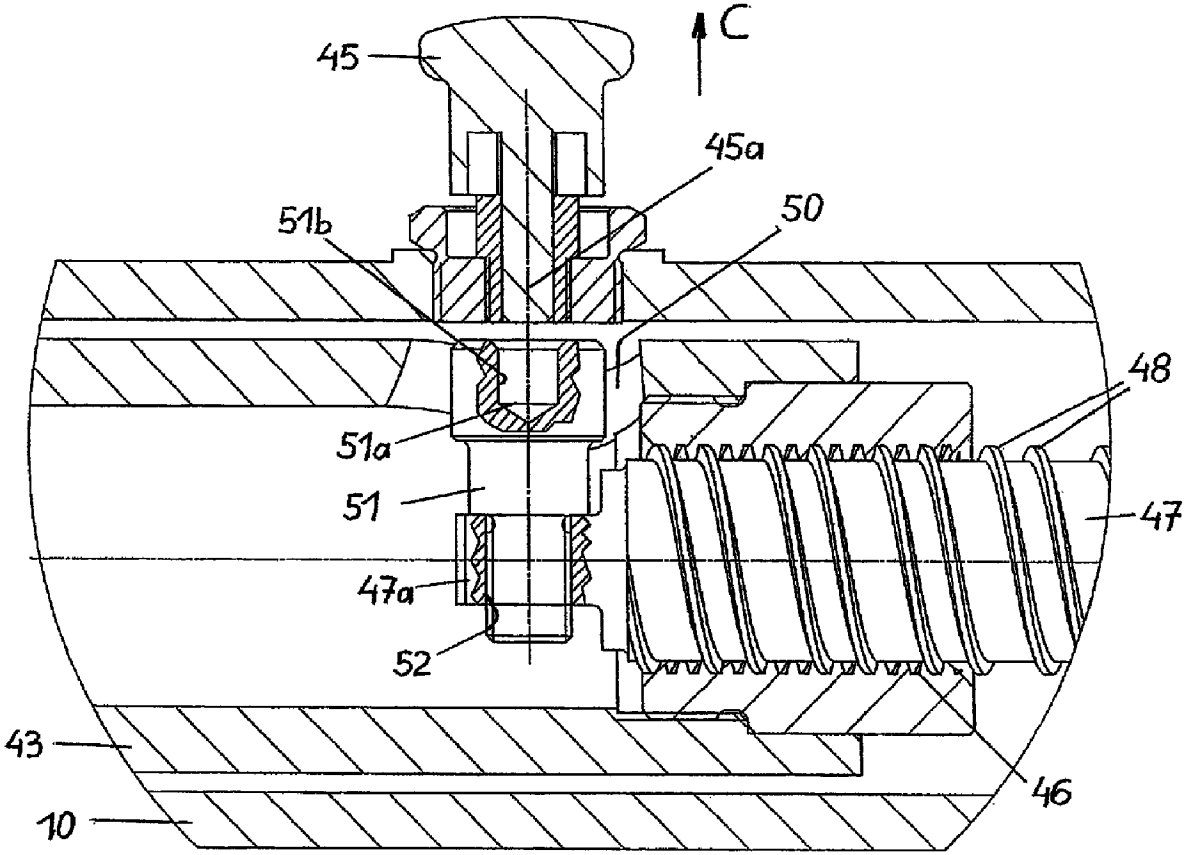
FIG. 5B shows detail B of FIG. 5 on an enlarged scale compared with FIG. 5 and in another position.

As soon as, in contrast, as can be seen in FIG. 5B, the first bolt 45 is moved upward in the direction of the arrow C, the second bolt 51 is released by the first bolt 45, as a result of which the control spindle 47 can be rotated. Since the control spindle 47 is coupled rotationally by means of the second bolt 51 to the sleeve 43, the control rod 42 and the shaft 21, the shaft 21 is rotated via the sleeve 43 and the control rod 42 by a rotation of the handwheel 41, as a result of which the brush 23 is pivoted along the inner wall of the pipeline 1.

Figure 5C:
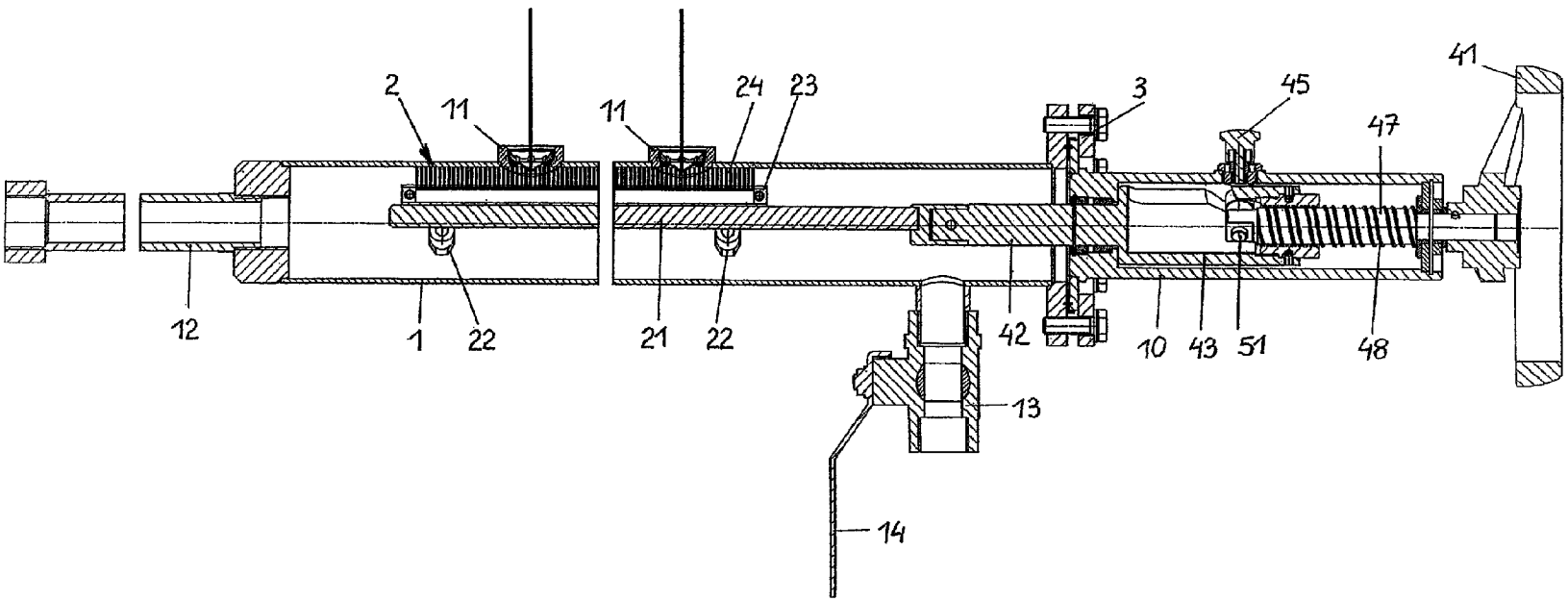
FIG. 5C shows the first embodiment of an apparatus according to the invention in an axial section, in a fourth operating position.

One of these further operating positions is shown in FIG. 5C. As a result of this, both the spray nozzles 11 and the inner wall of the pipeline 1 can be cleaned.

An apparatus is therefore produced, by means of which the cleaning device 2 which is situated in the pipeline 1 can be both displaced and pivoted as desired with respect to the pipeline 1, as a result of which dirt particles which are situated on the spray nozzles 11 and on the inner wall of the pipeline 1 are detached from the spray nozzles 11 and from the inner wall of the pipeline 1.

In order to remove said dirt particles from the pipeline 1, the valve which is situated in the connection piece 13 is moved into its open position by pivoting of the hand lever 14, as a result of which the liquid which is fed via the line 12 enters the pipeline 1 and flows away via the connection piece 13. As a result, dirt particles which are situated in the pipeline 1 and have been detached from the spray nozzles 11 and/or from the inner wall of the pipeline 1 by means of the brush 24 during the cleaning operation are led away through the connection piece 13.

The second embodiment of an apparatus according to the invention explained using FIG. 6, FIG. 6A, FIG. 6B and FIG. 6C differs from the first embodiment in that the second bolt 51 which is inserted into the hole 52 which is provided in the projection 47*a* of the control spindle 47 is configured with a compression spring 53 which is situated between the projection 47*a* and the bolt head 51*a*, and in that the first bolt 45 which is screwed into a hole 10*a* which is provided in the housing 10 can be set to three different height positions.

Figure 6:
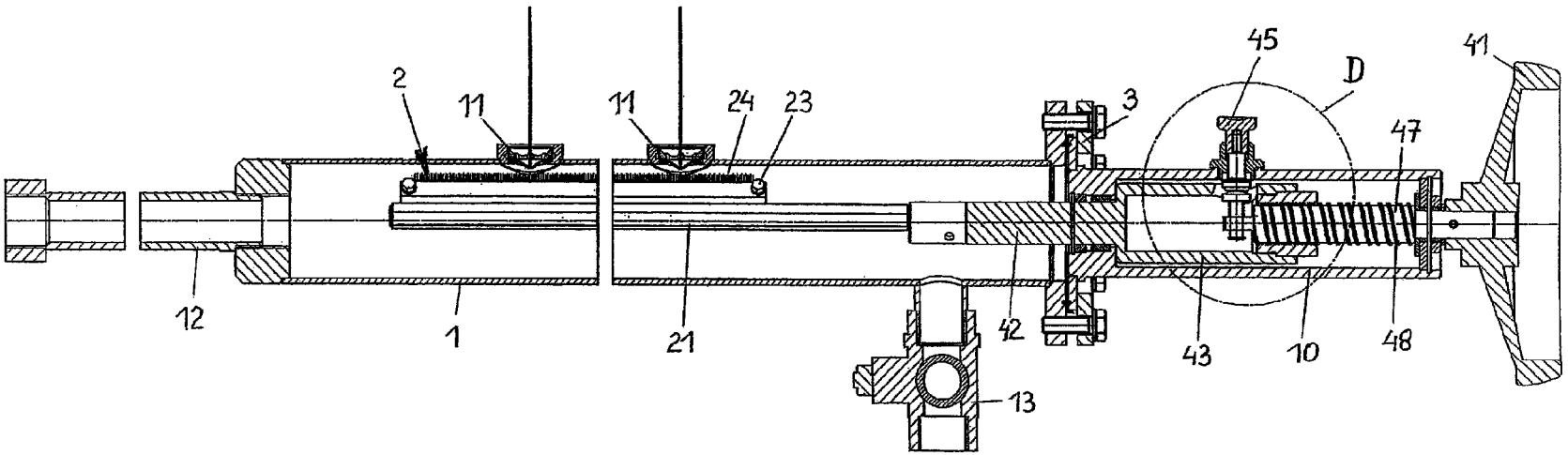
FIG. 6 shows a second embodiment of the apparatus according to the invention, in an axial section and in a middle operating position.
Figure 6A:
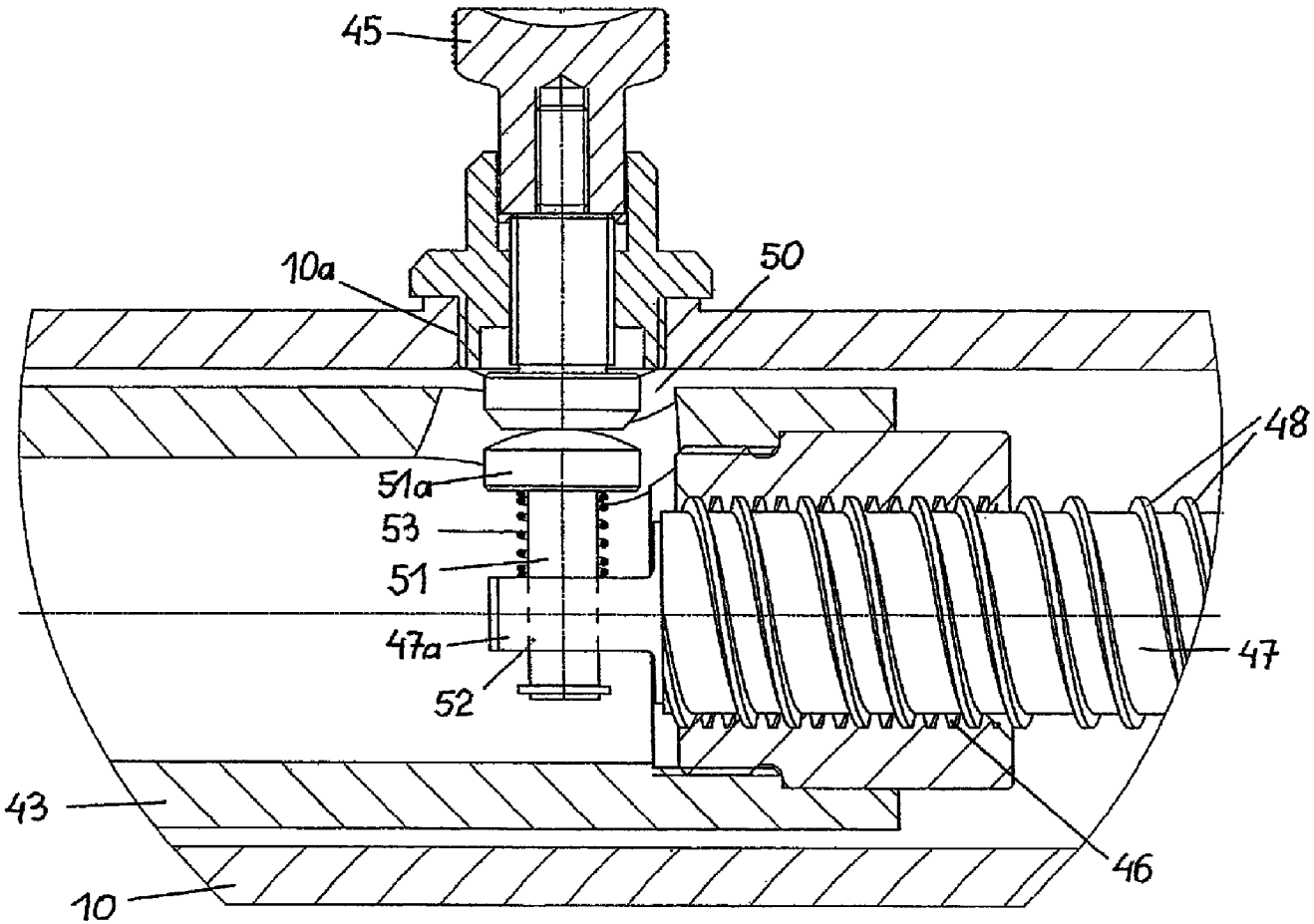
FIG. 6A shows detail D of FIG. 6, on an enlarged scale compared with FIG. 6, and FIG. 6B and FIG. 6C show the second embodiment of the apparatus according to the invention, in each case in an axial section and in two further operating positions.

In the position which is shown in FIG. 6 and FIG. 6A, both the bolt 45 and the second bolt 51 protrude into the hole 50 which is situated at the end of the slot 44, as a result of which the control rod 42 and the shaft 21 cannot be either rotated or displaced and the cleaning device is situated in its inoperative position.

Figure 6B:
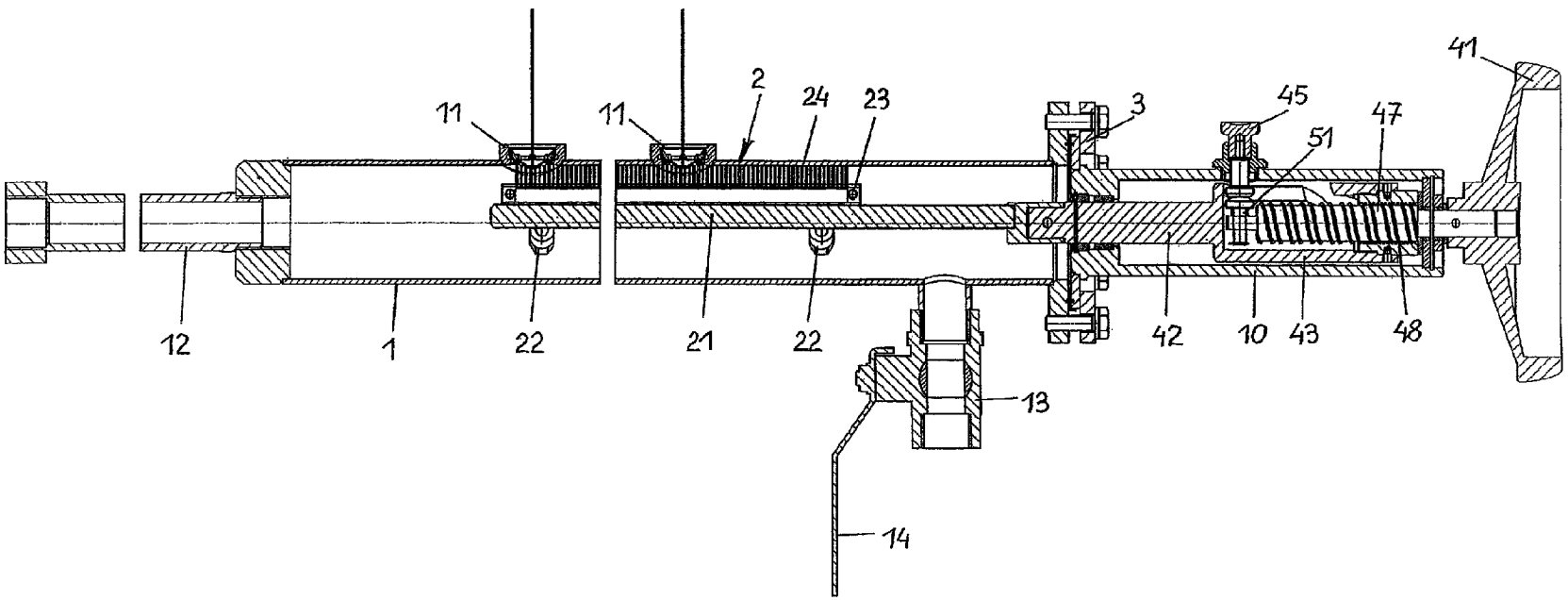

In the position which is shown in FIG. 6B, the first bolt 45 protrudes so far into the slot 44 that the second bolt 51 has been moved counter to the action of the compression spring 53 in such a way that the bolt head 51*a* is situated outside the slot 44. It is the starting position of the control spindle 47 and the control rod 21. Here, by way of a rotation of the handwheel 41, a displacement of the cylindrical sleeve 43, the control rod 42 and the shaft 21 takes place by the slotted guide and a displacement of the brush 24 takes place in the longitudinal direction of the pipeline 1.

Figure 6C:
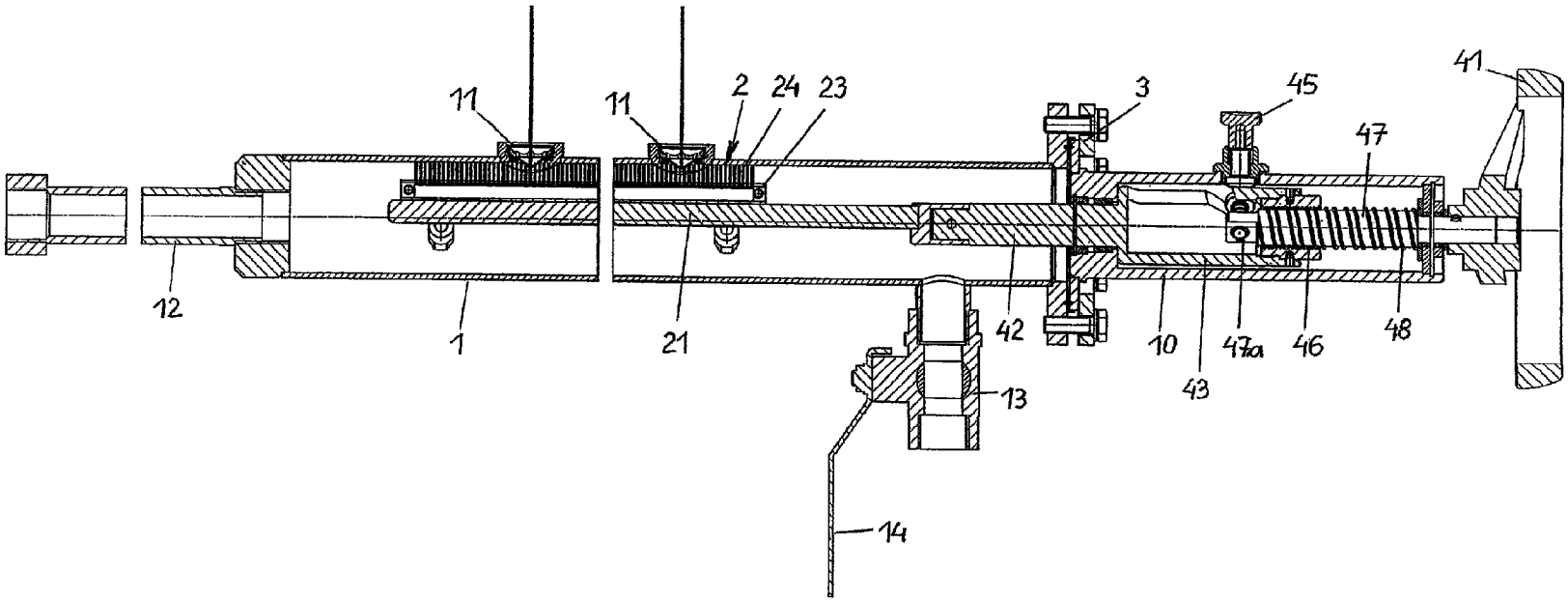

As soon as, as shown in FIG. 6C, the first bolt 45 has been moved so far upward that it is situated outside the hole 50, whereas the bolt head 51*a* has passed into the hole 50 under the action of the compression spring 53, the control spindle 47 is rotationally coupled to the cylindrical sleeve 43 and, via the latter, to the control rod 42 and the shaft 21. As soon as the handwheel 41 is rotated, the brush 24 is pivoted as a result along the inner wall of the pipeline 1, as a result of which said pipeline 1 can be cleaned.

An apparatus is therefore likewise produced, by means of which the cleaning device 2 which is situated within the pipeline 1 can be both displaced and pivoted as desired along the inner wall of the pipeline 1.

The invention claimed is:

1. An apparatus for spraying a liquid onto a wire or onto a felt in a paper production facility, comprising:

a pipeline for supplying the liquid, said pipeline defining a longitudinal direction;

spray nozzles formed to eject the liquid;

a shaft with a cleaning device for the spray nozzles or for the inner wall of the pipeline disposed within said pipeline;

said shaft being configured with a cylindrical sleeve formed with a slotted guide and a thread and disposed in a housing adjoining said pipeline;

a control spindle having a thread disposed to mesh with said thread of said cylindrical sleeve;

a first engagement device disposed for transverse adjustment relative to said housing and projecting into said slotted guide in a first position, as a result of which, during a rotation of said control spindle, said shaft is displaced in the longitudinal direction of said pipeline;

a second engagement device disposed for coupling said control spindle to said cylindrical sleeve in terms of a rotation thereof, as a result of which, after disengagement of said first engagement device out of said slotted guide, said shaft is rotatable by said control spindle.

2. The apparatus according to claim 1, wherein said first and second engagement device are a first bolt and a second bolt, respectively.

3. The apparatus according to claim 2, wherein said second bolt is seated in a transverse hole formed in said control spindle and is loaded toward radial adjustment under action of a control spring, said second bolt bearing against an inner end of said first bolt.

4. The apparatus according to claim 3, wherein, after an adjustment of said first bolt radially to the outside, said second bolt projects into said slotted guide under the action of said control spring.

5. The apparatus according to claim 2, wherein said first bolt is adjustably disposed:

into a first position, in which said first bolt projects so far into said slotted guide that said second bolt is situated outside said slotted guide;

into a second position, in which said first bolt and said second bolt are situated in said slotted guide; and into a third position, in which said first bolt is situated outside said slotted guide; and wherein said first bolt can be fixed in the first, second, and third positions.

6. The apparatus according to claim 1, wherein said second engagement device which is situated in a transverse hole formed in said control spindle is loaded toward radial adjustment under action of a control spring, said second engagement device bearing against an inner end of said first engagement device.

7. The apparatus according to claim 1, wherein said first engagement device is adjustably disposed:

into a first position, in which said first engagement device projects so far into said slotted guide that said second engagement device is situated outside said slotted guide;

into a second position, in which said first engagement device and said second engagement device are situated in said slotted guide; and into a third position, in which said first engagement device is situated outside said slotted guide; and wherein said first engagement device can be fixed in the first, second, and third positions.

8. The apparatus according to claim 1, wherein said second engagement device is insertable into a transverse hole formed in said control spindle and is formed with a length to project into said slotted guide.

9. The apparatus according to claim 8, wherein said first engagement device is adjustable into a first position, in which said first engagement device projects into said slotted guide, and into a second position, in which said first engagement device is situated outside said slotted guide.

10. The apparatus according to claim 8, wherein a wall of said housing is formed with a threaded hole, into which said first bolt can be screwed and can be set in different positions.

11. An apparatus for spraying a liquid onto a wire or onto a felt in a paper production facility, comprising:

a pipeline for supplying the liquid, said pipeline defining a longitudinal direction;

spray nozzles formed to eject the liquid;

a shaft with a cleaning device for the spray nozzles or for the inner wall of the pipeline disposed within said pipeline;

said shaft being configured with a cylindrical sleeve disposed in a housing adjoining said pipeline, said cylindrical sleeve having a slotted guide formed therein and an inner thread;

a control spindle having a thread disposed to interact with said inner thread in said cylindrical sleeve;

a first engagement device disposed for transverse adjustment relative to said housing and projecting into said slotted guide in a first position in which said thread of said cylindrical sleeve and said thread of said spindle mesh with one another and a rotation of said control spindle causes said shaft to be displaced in the longitudinal direction of said pipeline; and a second engagement device disposed for coupling said control spindle to said cylindrical sleeve in terms of a rotation thereof, as a result of which, after disengagement of said first engagement device out of said slotted guide, said shaft is rotatable by said control spindle.

* * * * *